US008460132B2

(12) United States Patent
Miller et al.

(10) Patent No.: US 8,460,132 B2
(45) Date of Patent: Jun. 11, 2013

(54) SOFTBALL TRAINING DEVICE AND METHOD OF USING THE SAME

(76) Inventors: Brad Miller, Holliston, MA (US); John Miller, Holliston, MA (US)

( * ) Notice: Subject to any disclaimer, the term of this patent is extended or adjusted under 35 U.S.C. 154(b) by 233 days.

(21) Appl. No.: 12/925,986

(22) Filed: Nov. 3, 2010

(65) Prior Publication Data

US 2012/0021854 A1 Jan. 26, 2012

Related U.S. Application Data

(60) Provisional application No. 61/400,168, filed on Jul. 23, 2010.

(51) Int. Cl.
*A63B 69/00* (2006.01)

(52) U.S. Cl.
USPC ..... 473/452; 473/422; 473/451

(58) Field of Classification Search
USPC . 473/422, 451, 452, 266, 269, 270; D21/688, D21/780; 482/71, 80, 79
See application file for complete search history.

(56) References Cited

U.S. PATENT DOCUMENTS 3,352,559 A * 11/1967 Larsen ..... 473/269
3,913,951 A * 10/1975 LeFebvre, Jr. ..... 285/223
4,560,165 A * 12/1985 Witteman et al. ..... 473/269
4,694,684 A * 9/1987 Campbell, III ..... 482/146
5,318,290 A * 6/1994 Sawyer ..... 473/217
5,435,320 A * 7/1995 Seitz ..... 600/595
D383,510 S * 9/1997 Bernardson ..... D21/688
5,810,673 A * 9/1998 Castleberry ..... 473/217
6,422,872 B1 * 7/2002 Outlaw ..... 434/247
D477,376 S * 7/2003 O'Dell et al. ..... D21/780
7,488,265 B2 * 2/2009 Miller et al. ..... 473/452
2012/0021854 A1 * 1/2012 Miller et al. ..... 473/451

* cited by examiner

*Primary Examiner* — Mitra Aryanpour
(74) *Attorney, Agent, or Firm* — Kriegsman & Kriegsman

(57) ABSTRACT

A softball training device includes a plate assembly pivotally connected to a support member. The plate assembly includes a flat, circular balance plate and a downwardly protruding kick stand formed on its rear end. The support member includes an enlarged base and rectangular mounting bracket transversely disposed on the base, the balance plate directly teetering on the mounting bracket. In use, the training device can be used to train a hitter to maximize lower power drive. Specifically, the hitter centers her rear foot on the balance plate and positions her other foot in front of the device. The hitter then loads her weight rearward, the kick stand keeping the balance plate horizontal. The hitter finally transfers her weight forward through accelerated hip and torso rotation so that the balance plate pivots forward and strikes the base to create an audible signal. With hips and torso initiating the forward movement, the arms are similarly pulled forward so the bat travels through the hitting zone.

10 Claims, 7 Drawing Sheets

SOFTBALL TRAINING DEVICE AND METHOD OF USING THE SAME

CROSS-REFERENCE TO RELATED APPLICATIONS

The present application claims the benefit under 35 U.S.C. 119(e) of U.S. provisional Patent Application Ser. No. 61/400,168, filed Jul. 23, 2010, the disclosure of which is incorporated herein by reference.

BACKGROUND OF THE INVENTION

The present invention relates generally to athletic training devices and more particularly to softball training devices.

In order to throw a softball in the proper manner, a pitcher is required to engage in a well-timed and fluid sequence of interrelated actions. As part of the set-up process, the dominant, or front, foot of the pitcher is positioned on the pitching rubber and the non-dominant, or rear, foot of the pitcher is positioned directly behind the pitching rubber. With her feet disposed in the manner set forth above, the pitcher leans rearward such that her center of gravity is aligned with her rear leg. In this capacity, the majority of the weight of the pitcher is effectively loaded in the rear hip, leg and foot.

To initiate the pitching process, the pitcher first transfers her weight from her rear hip, leg and foot forward into her front leg and foot (i.e., by moving the pitcher's center of gravity forward). Through this quick weight transfer, the front leg is now loaded for explosion, with much of the weight being supported in the ball of the pitcher's front foot.

Immediately thereafter, the pitcher explodes forward by driving her front foot off the pitching rubber, the forward drive being similar in nature to the manner in which a sprinter lunges off a starting block. With the body of the pitcher accelerating forward, the dominant arm, which is holding the softball, swings towards the batter in a windmill-like manner. If desired, the pitcher may rotate her pitching arm a full 360 degrees to increase arm speed. Ultimately, the pitcher releases the softball, the momentum of the arm and body of the pitcher causing the softball to travel in the direction of the intended target with significant velocity.

As can be appreciated, the utilization of proper mechanics when pitching a softball is highly encouraged. The use of proper softball pitching mechanics serves to, among other things, (i) maximize ball velocity upon release and thereby improve performance, and (ii) minimize the stress placed on the pitcher's arm and thereby reduce the likelihood of injury.

In particular, it has been found that a crucial mechanical component of the process of pitching a softball relates to the ability of a pitcher to properly distribute, or transfer, body weight forward to initiate delivery. Most notably, a pitcher who is able to maximize the transfer of her lower body mass in the forward direction at the commencement of her delivery can in turn generate considerable power while limiting arm strain. This ability to initiate delivery using the lower body of the pitcher (i.e., the dominant hip, leg and foot) is referred to herein simply as the rear, or backside, power drive.

Traditionally, pitchers rely on instructors and/or video equipment to monitor the extent that pitchers exhibit rear power drive. Although useful, instructors and/or video equipment are not always readily available for a pitcher and, in addition, can be relatively expensive in nature.

Accordingly, training devices designed to improve pitching performance are well known in the art. For example, in U.S. Pat. No. 7,488,265 to B. Miller et al., the disclosure of which is incorporated by reference, there is shown a training device for throwing a baseball that includes a plate assembly pivotally connected to a support member. The plate assembly includes a flat, rectangular balance plate and a sleeve disposed transversely across the bottom surface of the balance plate. The support member includes an elongated support arm on which the sleeve is adapted to teeter and a generally T-shaped strike plate connected to the support arm. In use, the training device can be used in the following manner to train a pitcher to exert maximum rear leg drive while throwing a baseball. Specifically, the training device is disposed on a flat, level flooring surface such that the plate assembly teeters on the support member. The pitcher then centers his rear foot on the balance plate and lifts his front knee. At this time, the pitcher drives his rear knee forward until the balance plate pivots forward and contacts the strike plate which in turn generates an audible signal. With the majority of the body weight of the pitcher displaced behind his rear knee, the pitcher begins his delivery. Because the pitcher is able to use the majority of his body weight to power his delivery, the pitcher is able to throw the baseball with greater velocity and with less strain exerted on his pitching arm.

Although well known and widely used in the art, baseball training devices of the type described above are not considered ideal for use in softball training applications due to the different mechanics associated with pitching a baseball and a softball. For example, the dominant foot of a baseball pitcher traditionally extends in parallel contact with the pitching rubber during the rear leg drive (i.e., with toes pointing in the third base direction) whereas the dominant foot of a softball pitcher traditionally runs at a right angle relative to the pitching rubber during the rear leg drive (i.e., with toes pointing in the home plate direction).

SUMMARY OF THE INVENTION

It is an object of the present invention to provide a novel training device for throwing a softball.

It is another object of the present invention to provide a training device as described above that is designed to train a pitcher to exert maximum rear leg drive when throwing a softball.

It is yet another object of the present invention to provide a training device as described above that can also be used to train a softball hitter to maximize forward weight transfer when swinging a bat.

It is still another object of the present invention to provide a training device as described above that has a limited number of parts, is inexpensive to manufacture, is easy to use and is highly portable in nature.

Accordingly, as one feature of the present invention, there is provided a softball training device, the softball training device comprising (a) a plate assembly, and (b) a support member on which the plate assembly is pivotally mounted, the plate assembly being naturally biased to balance at a substantially horizontal position, (c) wherein the plate assembly is capable of pivoting forward past the generally horizontal position, the plate assembly being incapable of pivoting rearward past the substantially horizontal position.

As another feature of the present invention, there is provided method of training a pitcher to throw a softball with maximum rear leg drive, the method comprising the steps of (a) providing a softball training device that comprises a plate assembly and a support member that are pivotally coupled together, the plate assembly being adapted to teeter on the support member, the plate assembly being capable of pivoting forward past a generally horizontal position, the plate assembly being incapable of pivoting rearward past the generally horizontal position, (b) placing the dominant foot of the pitcher on the plate assembly in the forward direction, (c) positioning the non-dominant foot of the pitcher behind the plate assembly, (d) loading the weight of the pitcher rearward into the non-dominant hip, leg and foot of the pitcher, (e) transferring the weight of the pitcher forward into the dominant hip, leg and foot such that the plate assembly pivots forward and contacts the support member, (f) exploding the pitcher forward by pushing the dominant foot off the plate assembly, and (g) after the exploding step, throwing the softball in the forward direction by swinging the dominant arm of the pitcher while holding the softball and, subsequent thereto, releasing the softball.

As yet another feature of the present invention, there is provided method of training a batter to hit a softball with maximum rear leg drive, the method comprising the steps of (a) providing a softball training device that comprises a plate assembly and a support member that are pivotally coupled together, the plate assembly being adapted to teeter on the support member, the plate assembly being capable of pivoting forward past a generally horizontal position, the plate assembly being incapable of pivoting rearward past the generally horizontal position, (b) placing the dominant foot of the batter on a center transverse line of the plate assembly, (c) positioning the non-dominant foot of the batter in front of the balance plate, (d) loading the weight of the batter rearward into the non-dominant hip, leg and foot of the batter, (e) transferring the weight of the batter forward through accelerated hip and torso rotation such that the plate assembly pivots forward and contacts the support member, and (f) after the transferring step, swinging a bat to hit the softball.

Various other features and advantages will appear from the description to follow. In the description, reference is made to the accompanying drawings which form a part thereof, and in which is shown by way of illustration, various embodiments for practicing the invention. The embodiments will be described in sufficient detail to enable those skilled in the art to practice the invention, and it is to be understood that other embodiments may be utilized and that structural changes may be made without departing from the scope of the invention. The following detailed description is therefore, not to be taken in a limiting sense, and the scope of the present invention is best defined by the appended claims.

BRIEF DESCRIPTION OF THE DRAWINGS

In the drawings wherein like reference numerals represent like parts.

DETAILED DESCRIPTION OF THE PREFERRED EMBODIMENT

Training Device (11)

Figure 1:
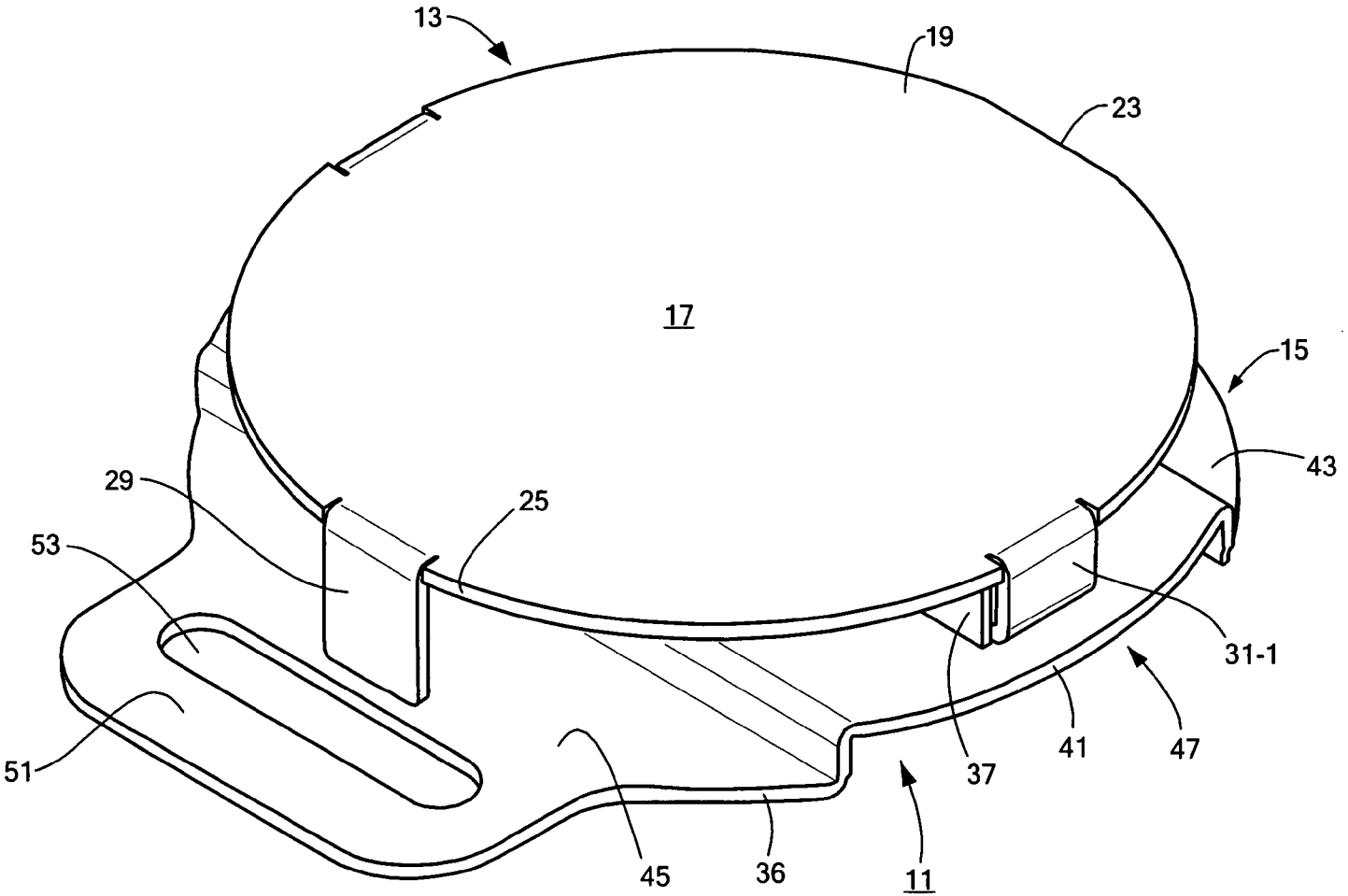
FIG. 1 is an enlarged, top perspective view of a softball training device constructed according to the teachings of the present invention.

Referring now to FIGS. 1-4, there is shown a softball training device that is constructed according to the teachings of the present invention and identified generally by reference numeral 11. As will be described further in detail below, softball training device 11 can be used as a training instrument for teaching proper weight transfer and, more specifically, maximum backside power drive during the processes pitching and hitting a softball, which are principal objects of the present invention.

Training device 11 comprises a plate assembly 13 that is pivotally coupled to a support member 15. As will be described in detail below, plate assembly 13 is designed to balance on support member 15 and, in turn, pivot forward in relation thereto upon receiving a suitable forward, downward force.

Plate assembly 13 comprises a balance plate 17 that is preferably constructed of a rigid and durable material, such as a lightweight aluminum, plastic or composite thereof. Balance, or standing, plate 17 is represented herein as being in the form of an enlarged circular disc that is shaped to include a substantially flat top surface 19, a substantially flat bottom surface 21, a front end 23, a rear end 25 and a pair of opposing sides 27-1 and 27-2.

Balance plate 17 preferably has a diameter of approximately 11.08 inches and a thickness of approximately 0.19 inches. As such, balance plate 17 is appropriately dimensioned to support the dominant foot of a variety of different sized users. However, it is to be understood that balance plate 17 is not limited to the particular size and/or shape set forth above. Rather, the particular configuration and/or dimensions of balance plate 17 could be modified without departing from the spirit of the present invention.

As seen most clearly in FIG. 1, plate assembly 13 also includes a plate support, or kick stand, 29 that is formed onto rear end 25. Plate support 29 is represented herein as a rectangular tab, approximately 2.08 inches in length, that extends orthogonally down from bottom surface 21 at rear end 25. As will be described further in detail below, plate support 29 is sized and shaped to selectively contact support member 15 in order limit the degree of rearward teetering by balance plate 17. More specifically, kickstand 29 is designed to prevent balance plate 17 from pivoting rearward past horizontal (i.e., parallel with support member 15). This enables balance plate 17 to remain initially stable when the weight of the user is loaded rearward, as will be described further below.

A pair of opposing retention arms, or tabs, 31-1 and 31-2 are formed onto sides 27-1 and 27-2, respectively, of balance plate 17. Each arm 31 is generally L-shaped in transverse cross-section and includes an upper portion 33 that extends orthogonally down from bottom surface 21 and a lower portion 35 that extends orthogonally inward from the free end of upper portion 33. As will be described further in detail below, L-shaped retention arms 31 engage support member 15 to keep plate assembly 13 loosely coupled thereto.

Figure 2:
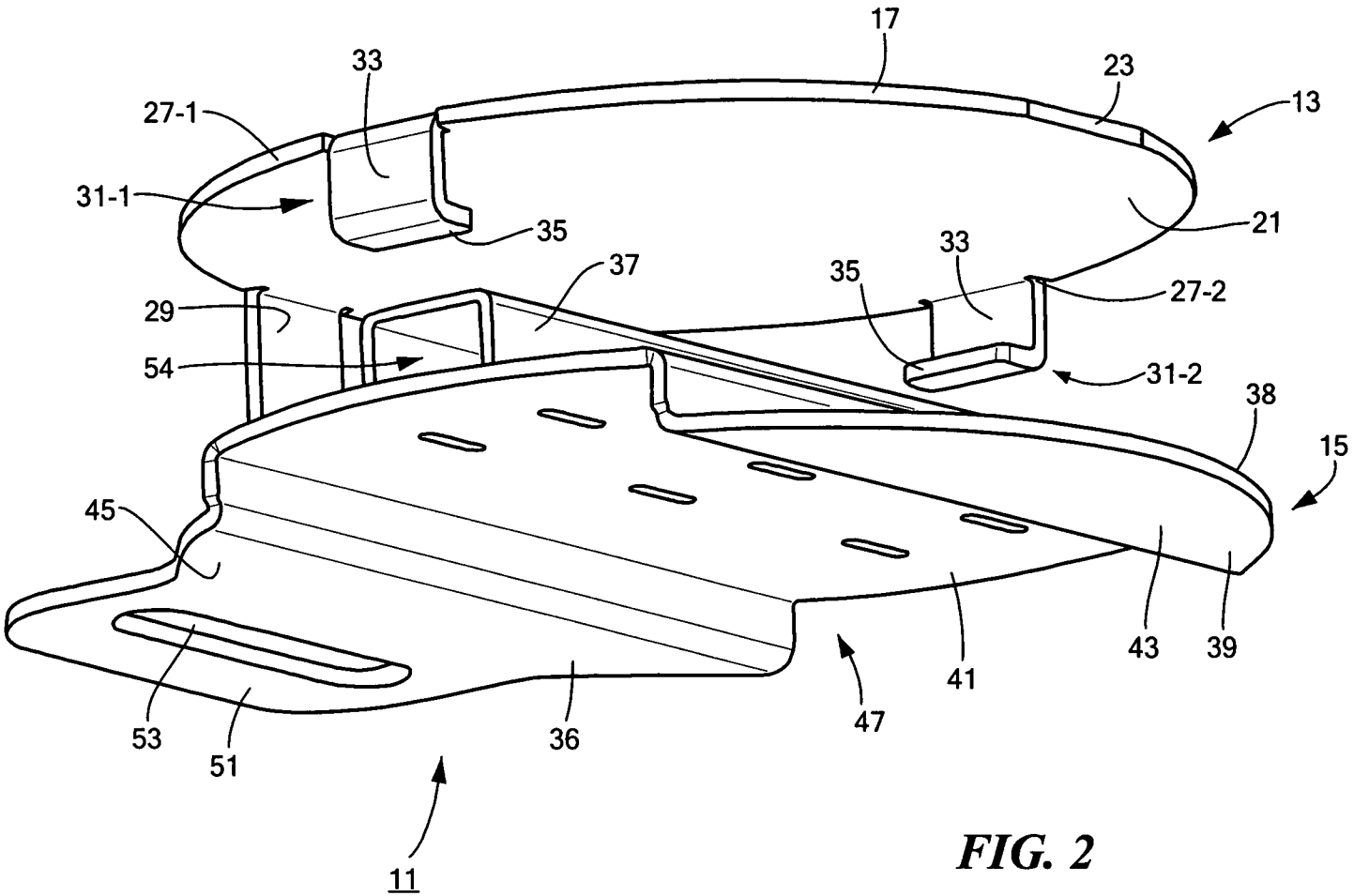
FIG. 2 is an enlarged, exploded, bottom perspective view of the softball training device shown in FIG. 1.

As seen most clearly in FIG. 2, support member 15 comprises an enlarged, generally, disc-shaped base 36 and a transverse mounting bracket, or fulcrum, 37. For simplicity purposes only, base 36 and bracket 37 are represented as two separately constructed pieces that are subsequently joined together (e.g., through spot welding). However, it is to be understood that support member 15 could be alternatively constructed as a unitary member without departing from the spirit of the present invention.

Base 36 is preferably formed as a unitary member that is constructed out of a rigid and durable material, such as a lightweight aluminum, plastic or composite thereof. Base 36, which has a diameter of approximately 12.00 inches and a thickness of approximately 0.19 inches, includes a top surface 38 and a bottom surface 39.

Figure 3:
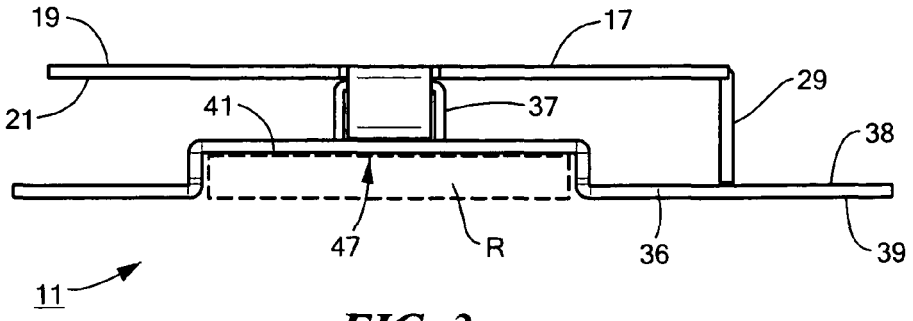
FIG. 3 is a left end view of the softball training device shown in FIG. 1. the device being shown positioned over a pitching rubber, the pitching rubber being shown in dashed form.
Figure 4:
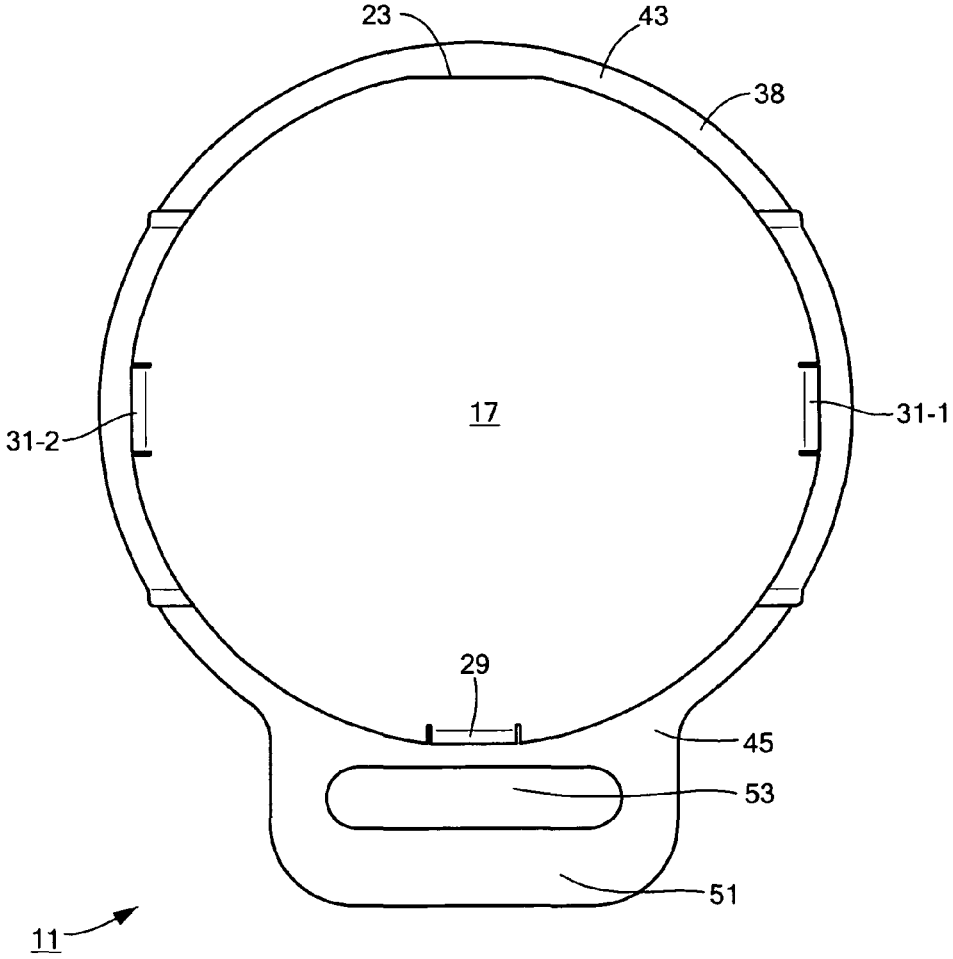
FIG. 4 is a top view of the softball training device shown in FIG. 1.
Figure 5A:
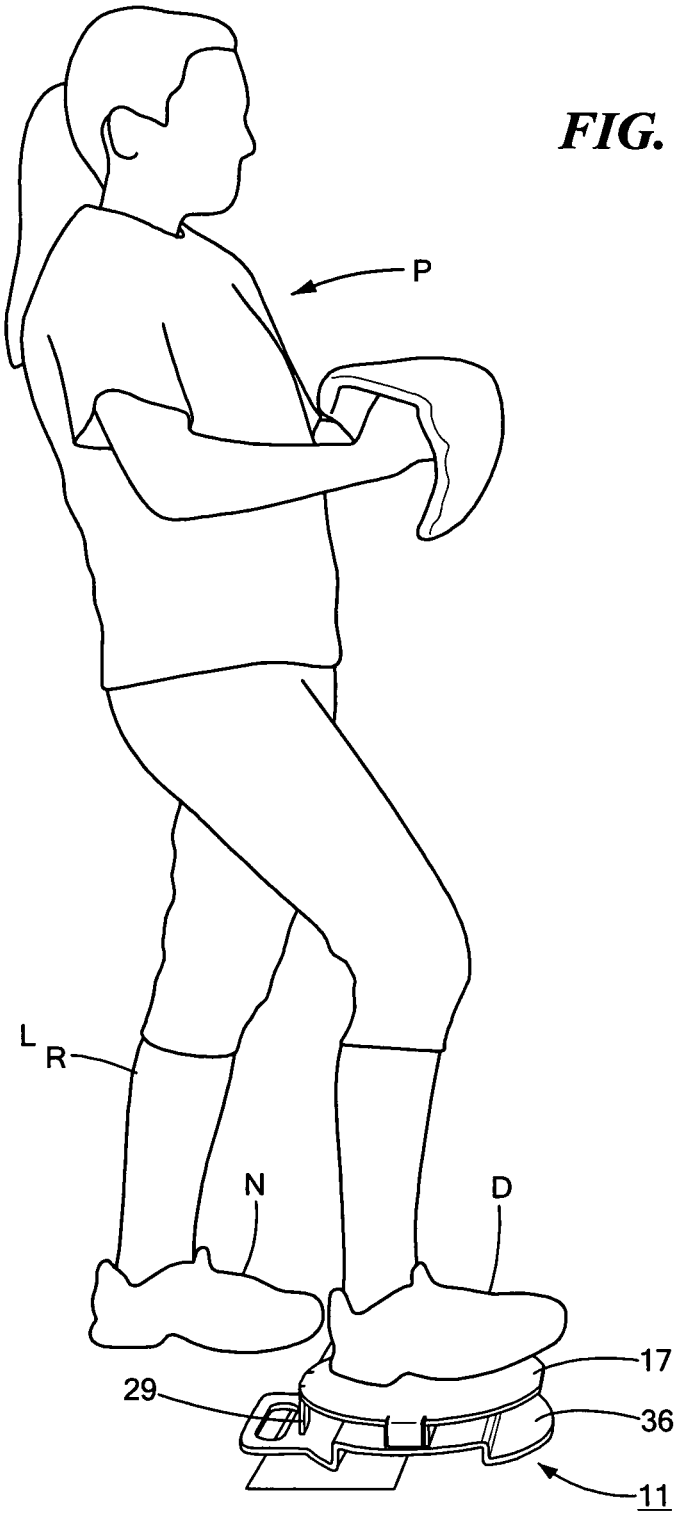
FIGS. 5(*a*)-(*d*) are right end perspective views of the softball training device shown in FIG. 1, the softball training device being shown in use in a training capacity at various stages of the softball pitching process.
Figure 5B:
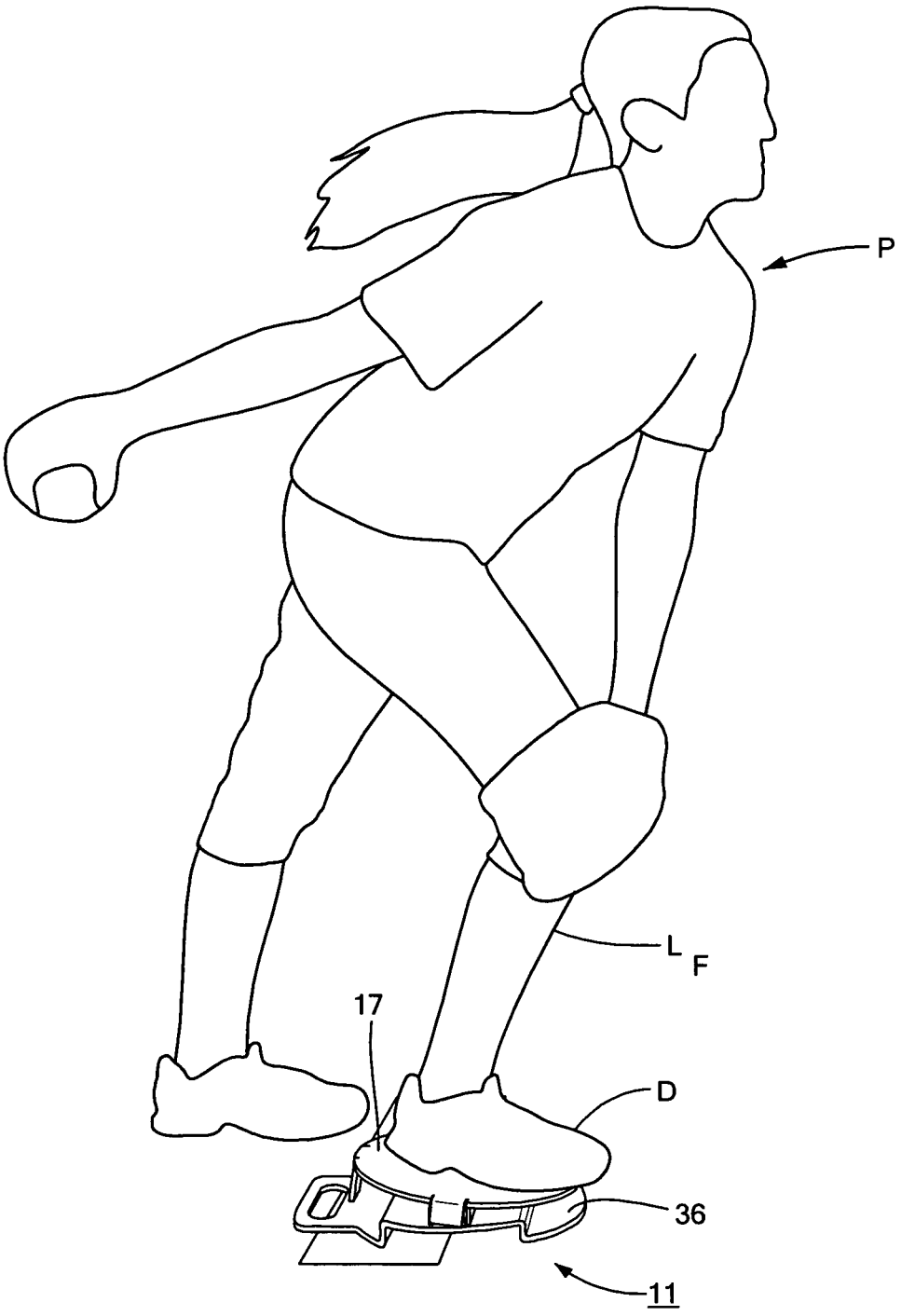
Figure 5C:
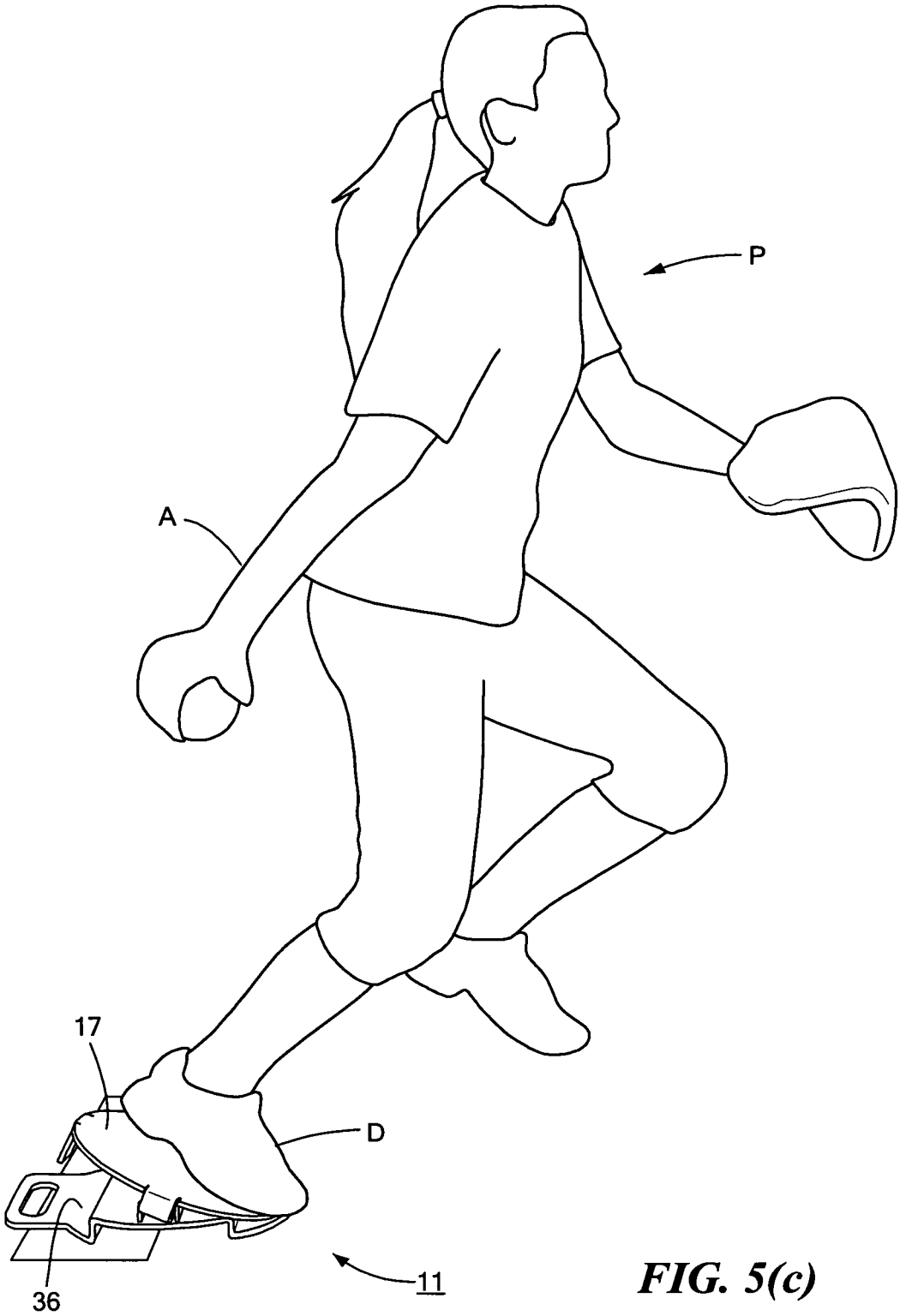
Figure 5D:
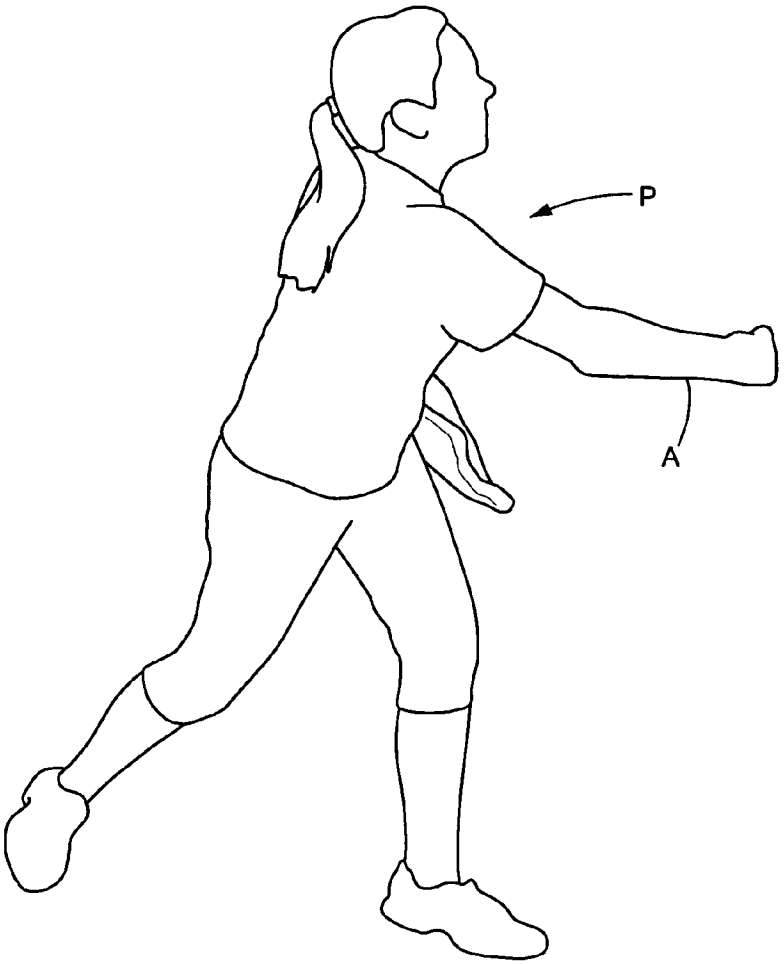
Figure 5D:
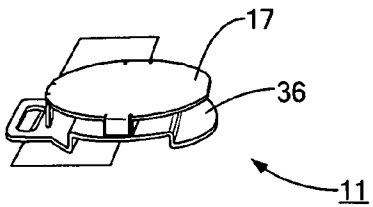

As shown in FIGS. 1-3, base 36 is shaped to include a central step, or rise, 41 that extends transversely across the entirety of its width along its center line and that separates front and rear co-planar sections 43 and 45 in base 36 (i.e., with top surface 38 of base 36 being higher along rise 41 than along front and rear sections 43 and 45). As can be seen, central rise 41 defines a cavity, or channel, 47 in the underside of base 15 that is generally rectangular in transverse cross-section, cavity 47 being approximately 6.00 inches in width and approximately 0.75 inches in height.

As can be appreciated, cavity 47 is dimensioned to fittingly receive a conventional pitching rubber R, as shown in FIG. 3. In other words, base 36 is designed to be firmly positioned on a pitcher's mound, with front and rear co-planar sections 47 and 49 of base 36 lying flush against the mound surface and pitching rubber R fittingly projecting up into cavity 47. In this capacity, it is to be understood that central step 41 suitably engages rubber R to prevent displacement (i.e., sliding) of training device 11 along the mound during use as a pitching training device, which is highly desirable.

Rear section 45 of base 36 is shaped to include an enlarged, rearwardly extending, generally rectangular flange 51 that extends the overall length of base 36 to approximately 14.11 inches. Flange 51 is generally flat and is shaped to define an elongated slot 53 that is dimensioned to receive a plurality of fingers. In this capacity, it is to be understood that rear section 45 is designed with an integral handle for carrying training device 11, which is highly desirable.

As seen most clearly in FIG. 2, elongated rectangular mounting bracket, or fulcrum, 37 has an inverted U-shape in transverse cross-section. Mounting bracket 37 extends transversely across top surface 38 of rise 41 along its center line and is permanently secured thereto by any conventional means (e.g., by spot welding mounting bracket 37 to base 15 through slots formed in the underside of base 15). As a result, mounting bracket 37 and rise 41 together define a transversely extending channel 54.

Accordingly, it is to be understood that with device 11 in its assembled form, bottom surface 21 of balance plate 17 lies directly on top of mounting bracket 37. Furthermore, the free ends of retention arms 31 project into opposite ends of channel 54 to permanently couple plate assembly 13 and support member 15 together (i.e., preclude vertical or lateral separation of components).

It should be noted that device 11 is designed such that there is considerable clearance (i.e., spacing) between retention arms 31 and mounting bracket 37 when balance plate 17 lies in its natural horizontal orientation. As a result of this loose coupling, balance plate 17 is capable of teetering forward on bracket 37 (i.e., with mounting bracket 31 serving as the fulcrum, or balance point, about which balance plate 17 is able to pivot relative to base 15).

Method of Training a Softball Pitcher Using Device (11)

Device 11 can be used in the following manner to train a softball pitcher to exert maximum backside power drive during the process of the throwing a softball. As part of the set-up process, the operator first positions bottom surface 39 of base 36 on the appropriate flooring surface and orientates device 11 such that front end 23 of balance plate 17 is directed towards the intended target (e.g., a catcher, batter or other similar object).

It should be noted that device 11 is designed for placement upon any relatively flat flooring surface (e.g., dirt mound, real or artificial grass field, cement basement, etc.). As a result, device 11 can be used frequently in a wide variety of environments, which is highly desirable.

It should also be noted that, as referenced in detail above, rise 41 in base 36 enables device 11 to be directly mounted over a pitching rubber, the fitting engagement precluding device 11 from sliding along the mound during use, which is also highly desirable.

With training device 11 positioned as such, the operator can commence the softball pitch training process. Referring now to FIGS. 5(*a*)-(*d*), device 11 is shown being used by a pitcher P at various stages during a pitch training process. In the first step, the dominant, or front, foot D (i.e., the right foot for a right-handed pitcher) of pitcher P is positioned directly on top surface 19 of balance plate 17 with the toes of pitcher P pointing towards front edge 23 (and the intended target). The non-dominant, or rear, foot N (i.e., the left foot for a right-handed pitcher) of pitcher P is then positioned directly behind device 11. At this time, pitcher P leans rearward so that her center of gravity is aligned with her rear leg $L_R$, as shown in FIG. 5(*a*). In this capacity, the majority of the weight of the pitcher is effectively loaded in the rear hip, leg and foot.

It should be noted that with the weight of pitcher P rearwardly loaded, kick stand 29 firmly contacts top surface 37 of rear section 45 and limits rearward pivoting of balance plate 17. As a result, balance plate 17 remains horizontally disposed and stable even in response to the application of the significant downward force upon its rear end 25, which is highly desirable.

To initiate the pitching process, pitcher P first transfers the majority of her weight from her rear leg, hip and foot forward into her front leg $L_F$ and front foot D, as shown in FIG. 5(*b*). This quickly executed forward weight transfer causes balance plate 17 to pivot forward until front end 23 of balance plate 17 strikes top surface 37 of front section 43.

It should be noted that the aforementioned weight transfer causes balance plate 17 to contact front section 43 of base 36 with a significant amount of force which, in turn, creates an substantial auditory signal (e.g., a loud metal clanking noise). As can be appreciated, this auditory signal serves to immediately notify pitcher P that the proper backside power drive has been executed, which is a principal object of the present invention. To the contrary, if training device 11 does not create such a signal at this stage of the pitching process, pitcher P can immediately deduce that she insufficiently exerts lower body drive, which is a significant mechanical pitching flaw.

With the weight of pitcher P largely supported in the ball of front foot D, pitcher immediately explodes forward by pushing and driving front foot D off pivoted balance plate 17, as shown in FIG. 5(*c*). As can be appreciated, device 11 is highly useful in providing immediate feedback whether pitcher P executes of proper timing when transitioning from rear power drive to front leg explosion, which is essential in perfecting the proper throwing motion.

With the body of pitcher P now exploding forward, the dominant arm A, which is holding the softball, swings forward in a windmill-like manner. If desired, pitcher P may rotate her pitching arm a full 360 degrees to increase arm speed. Ultimately, pitcher P releases the softball, as shown in FIG. 5(*d*), the momentum of arm A and body of pitcher P causing the softball to travel in the direction of the intended target with significant velocity. As pitcher P moves off training device 11, balance plate 17 returns to its natural horizontal position (i.e., parallel with base 36).

Method of Training a Softball Hitter Using Device (11)

Device 11 can be used in a similar manner as described in detail above to train a batter how to maximize and properly time lower body power during the process of hitting a softball. Specifically, the rear foot of the batter is positioned transversely across top surface 19 of balance plate 17 (i.e., with the toes of a right-handed hitter pointed towards side 27-1 and arch directed towards front end 23). The front foot is then positioned on the ground directly in front of device 11.

At this time, the hitter leans rearward so that her center of gravity is aligned with her rear leg. In this capacity, the majority of the weight of the batter is effectively loaded in the rear hip, leg and foot. As can be appreciated, with the weight of the hitter rearwardly loaded, kick stand 29 firmly contacts top surface 37 of rear section 45 and limits rearward pivoting of balance plate 17. As a result, balance plate 17 remains horizontally disposed and stable even in response to the application of the significant downward force upon its rear end 25, which is highly desirable.

To initiate the hitting process, the batter first transfers the majority of her weight from her rear leg, hip and foot forward into her front leg and foot through accelerated hip and torso rotation. This quickly executed forward weight transfer, in turn, causes balance plate 17 to pivot forward until front end 23 of balance plate 17 strikes top surface 37 of front section 43, thereby producing an auditory signal for the batter.

With the hitting process properly initiated through lower body weight transfer and hip rotation, the batter then subsequently uses her arms to swing the bat through the zone and hit the softball. As such, it is clear that device 11 is useful in providing immediate feedback to the hitter whether the timing of the rear power drive was proper within the hitting process.

Although not shown herein, it is to be understood that a visible center line may be applied to top surface 19 of balance plate 17 along its approximate midpoint using paint, tape or any other suitable type of marking. As can be appreciated, a center line would serve as a marker on which the dominant foot of the hitter is to be positioned when using training device 11 in hitting applications. Preferably, the center line would include one or more parallel friction strips (e.g., an adhesive-backed length of anti-slip tape) to prevent foot slippage during use.

The embodiment shown of the present invention is intended to be merely exemplary and those skilled in the art shall be able to make numerous variations and modifications to them without departing from the spirit of the present invention. All such variations and modifications are intended to be within the scope of the present invention as defined in the appended claims.

What is claimed is:

1. A softball training device, comprising:

(a) a plate assembly, the plate assembly comprising, (i) a balance plate, the balance plate comprising a flattened top surface, a flattened bottom surface, a front end, a rear end and a pair of opposing sides, and (ii) a downwardly extending plate support formed onto the rear end of the balance plate, the plate support being dimensioned to contact the support member when the balance plate is disposed in a substantially horizontal position, and (b) a support member on which the plate assembly is pivotally mounted, the plate assembly being naturally biased to balance at a substantially horizontal position, the support member comprising a base having a top surface and a bottom surface, the base being shaped to include a central rise that extends transversely across the width of the base, the central rise defining a rectangular cavity in the bottom surface of the base that is dimensioned to receive a pitching rubber, (c) wherein the plate assembly is capable of pivoting forward past the generally horizontal position, the plate assembly being incapable of pivoting rearward past the substantially horizontal position.

2. The softball training device as claimed in claim 1 wherein the balance plate is in the form of a thin, circular disc.

3. The softball training device as claimed in claim 1 wherein the plate assembly further includes a pair of opposing retention arms that engage the support member to keep plate assembly coupled thereto.

4. The softball training device as claimed in claim 1 wherein the support member further comprises:

a transverse mounting bracket formed on the top surface of the base, wherein the bottom surface of the balance plate is mounted the transverse mounting bracket and is adapted to teeter thereon.

5. The softball training device as claimed in claim 4 wherein the central rise separates and defines front and rear co-planar sections in the base.

6. The softball training device as claimed in claim 4 wherein an outwardly extending flange is formed in the base, the flange being shaped to define an elongated finger receiving slot for holding the softball training device.

7. The softball training device as claimed in claim 4 wherein the mounting bracket has an inverted U-shape in transverse cross-section.

8. A method of training a pitcher to throw a softball with maximum rear leg drive, the method comprising the steps of:

(a) providing a softball training device that comprises a plate assembly and a support member that are pivotally coupled together, the plate assembly being adapted to teeter on the support member, the plate assembly being capable of pivoting forward past a generally horizontal position, the plate assembly being incapable of pivoting rearward past the generally horizontal position, the support member comprising a base having a top surface and a bottom surface, the base being shaped to include a central rise that extends transversely across the width of the base, the central rise defining a rectangular cavity in the bottom surface of the base that is dimensioned to receive a pitching rubber, (b) placing the dominant foot of the pitcher on the plate assembly in the forward direction, (c) positioning the non-dominant foot of the pitcher behind the plate assembly, (d) loading the weight of the pitcher rearward into the non-dominant hip, leg and foot of the pitcher, (e) transferring the weight of the pitcher forward into the dominant hip, leg and foot such that the plate assembly pivots forward and contacts the support member, (f) exploding the pitcher forward by pushing the dominant foot off the plate assembly, and (g) after the exploding step, throwing the softball in the forward direction by swinging the dominant arm of the pitcher while holding the softball and, subsequent thereto, releasing the softball.

9. The method as claimed in claim 8 wherein the contact established between the plate assembly and the support member during the transferring step generates an audible signal.

10. A softball training device, comprising:

(a) a plate assembly, the plate assembly comprising, (i) a balance plate, the balance plate comprising a flattened top surface, a flattened bottom surface, a front end, a rear end and a pair of opposing sides, and (ii) a downwardly extending plate support formed onto the rear end of the balance plate, the plate support being dimensioned to contact the support member when the balance plate is disposed in a substantially horizontal position, and (b) a support member on which the plate assembly is pivotally mounted, the plate assembly being naturally biased to balance at a substantially horizontal position, the support member comprising, (i) an enlarged base having a top surface and a bottom surface, the base being shaped to include a central rise that extends transversely across the width of the base, the central rise separating and defining front and rear co-planar sections in the base, the central rise defining a rectangular cavity in the bottom surface of base that is dimensioned to receive a pitching rubber, and (ii) a transverse mounting bracket formed on the top surface of the base, (iii) wherein the bottom surface of the balance plate is mounted on the transverse mounting bracket and is adapted to teeter thereon, (c) wherein the plate assembly is capable of pivoting forward past the generally horizontal position, the plate assembly being incapable of pivoting rearward past the substantially horizontal position.

* * * * *